United States Patent [19]

McCormick

[11] Patent Number: 4,735,005

[45] Date of Patent: Apr. 5, 1988

[54] IDENTIFICATION TAG HOLDER

[75] Inventor: Daniel M. McCormick, Jacksonville, Fla.

[73] Assignee: Simple Signman Systems, Inc., Jacksonville, Fla.

[21] Appl. No.: 874,416

[22] Filed: Jun. 16, 1986

[51] Int. Cl.[4] ..... G04F 1/00

[52] U.S. Cl. ..... 40/10 D; 40/10 R; 40/19.5; 428/194; 428/35

[58] Field of Search ..... 40/19.5, 10 R, 10 B, 40/16; 428/194, 35

[56] References Cited

U.S. PATENT DOCUMENTS

| | | | |
|---|---|---|---|
| 3,464,135 | 9/1969 | Eidinger | 40/10 R |
| 4,016,664 | 4/1977 | Kaufmann | 40/10 R |
| 4,463,510 | 8/1984 | Windish | 40/19.5 |
| 4,525,944 | 7/1985 | Fast | 40/19.5 |
| 4,539,766 | 9/1985 | Fast | 40/10 R |
| 4,583,308 | 4/1986 | Taub | 40/19.5 |

*Primary Examiner*—Henry E. Raduazo

*Attorney, Agent, or Firm*—Arthur G. Yeager

[57] ABSTRACT

A transparent plastic tag holder attachable to a peg board hanger employed to support a plurality of packages of goods for sale, the tag holder being a flat T-shaped strip of two or more plastic sheets heat sealed to each other around their common perimeter, an elongated arm and a cross arm forming the T-shaped strip, a pair of spaced circular passageways at the free end portion of the arm to receive legs of the hanger, a slot adjacent the other end of the arm to receive the free end of the hanger, and the cross arm having a pocket therein disposed generally downwardly from the free end of the hanger and adapted to receive and maintain an identification tag. The tag holder includes another passageway generally between the pair of spaced passageways for attachment to a guarded J-hook hanger.

13 Claims, 2 Drawing Sheets

IDENTIFICATION TAG HOLDER

BACKGROUND OF THE INVENTION

It is a common method of modern marketing to display small consumer goods separately hung from peg board hangers. The goods may be separately packaged in plastic bags or in bubble packs on cards, or merely attached to cards as is well known. When such a display system is employed it is important to include an identification card or tag describing the product, showing its price, and including coded matter which the store may employ in its computerized inventory management. Satisfactory systems have not previously been devised for a variety of reasons. One troublesome item has been in finding a location and method of attachment for the identification card or tag. If it is not physically attached to the hanger there is confusion as to which card applies to which goods. One system employs a tag holder which is made of more than one piece of plastic which must then be assembled to each other for use, and such tag holders are then likely to become detached and lost. Furthermore, plastic parts which are folded and handled several times may break and require replacement.

It is an object of this invention to provide an improved identification tag holder for goods displayed on peg board hangers. It is another object of this invention to provide an improved flexible, tough plastic integral tag holder which is adaptable to several types of peg board hangers. Still other objects will become apparent from the more detailed description which follows.

BRIEF SUMMARY OF THE INVENTION

This invention relates to a display tag holder comprising a flat T-shaped strip of transparent plastic material, said strip including an elongated arm portion and a short lateral cross arm portion attached medially thereof to one end of said leg portion, said cross arm portion including a pocket means therein adapted to receive an identification tag, said elongated arm portion having a slotted passageway therethrough adjacent said cross arm portion and having adjacent the opposite end thereof a pair of laterally spaced circular passageways therethrough of substantially the same size and spacing as adjacent horizontal openings of a peg board to which said tag holder is attachable, said elongated arm portion having a lateral fold line adjacent said pair of circular passageways and positioned between said pair of circular passageways and said cross arm portion.

In a specific embodiment of this invention the tag holder is made of two or more sheets of the same type of plastic material, one sheet being thick and stiff and the other being thin and flexible, heat sealed to each other around the entire perimeter. In another embodiment the elongated arm portion of the strip at its free end has two sets of circular passageways and two molded fold lines adjacent the two sets respectively so that the tag holder will be adaptable to hangers of different lengths.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The display tag holder of this invention is designed for use in stores where individual items for sale are hung from a rod with a free end from which the items may be removed one at a time. It is important to have an identification tag which describes the goods, shows the price, and includes numbers or codes which the store employs in its computerized inventory control. Such codes are frequently read by a hand held electronic or magnetic reader which is directed at the identification tag as one passes the reader over it. Therefore, the most convenient placement for the identification tag is at the free end of the hanger rod. Such systems are adaptable to goods displayed on hanger bars attached to peg boards, channels or tracks into which slidable fixtures with hanger rods may be engaged, such as a guarded J-hook fixture.

Figure 1:
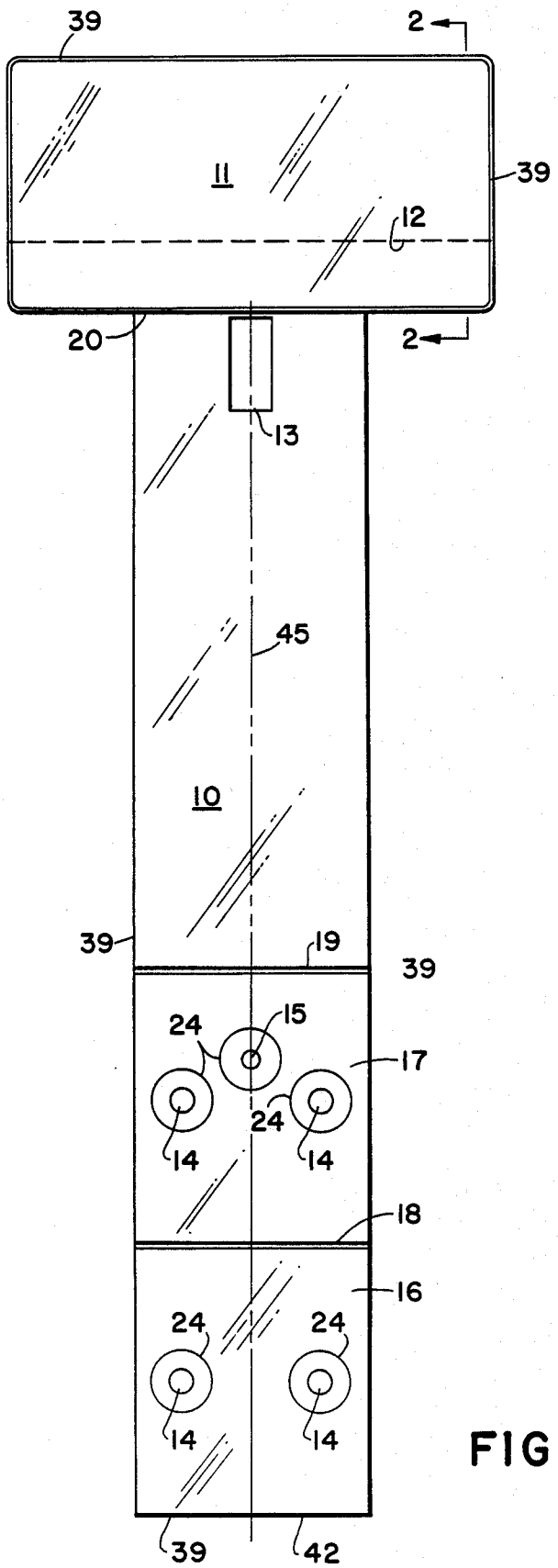
FIG. 1 is a top plan view of the tag holder of this invention.
Figure 2:
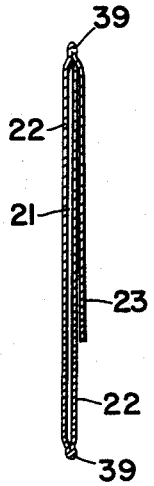
FIG. 2 is a cross sectional view taken along line 2—2 of FIG. 1.

In FIGS. 1–2 there is shown the structure of the display tag holder of this invention. The tag holder is a flat strip of tough flexible transparent plastic, preferably a polyvinylchloride plastic. Other plastic materials, such as polyethylene terephthalate, or others may be found usable to construct the tag holder according to this invention. The strip is in the form of a T having an elongated arm portion 10 and a relatively short lateral cross arm portion 11. The entire strip is made of two or more sheets sandwiched together and heat sealed together around the entire perimeter 39 of portions 10 and 11.

The structure of the plural sheets of plastic preferably includes at least one thick, stiff sheet 21 and at least one thin flexible sheet 22. In the embodiment shown in FIG. 2 the thick, stiff sheet 21 is a central layer between two thin, flexible sheets 22; all three being heat bonded together along their perimeters 39. The thick sheet 21 is 10–15 mils in thickness, preferably about 12, and is employed to provide a certain amount of stiffness to the strip. If used alone, however, it is more likely to tear or crack if folded upon itself. Accordingly, it has been found advantageous to employ at least one thin sheet 22 to be on the inside of any fold. Thin sheets 22 are about 4–8 mils in thickness, preferably about 6 mils, and they provide a ready flexibility and do not tear or crack easily. By providing a thin sheet 22 on each side of the thick sheet 21, the entire strip is protected against tearing or cracking regardless of which direction the strip is folded.

Cross arm portion 11 includes a pocket 12 into which an identification tag may be placed to show the name of the goods, its price, and coded inventory markings. The preferred type of pocket 12 involves a fourth sheet 23 (see FIG. 2) of thin plastic like sheets 22, which is sealed to sheet 22 around three edges to leave one side openable for inserting the identification tag.

Elongated arm portion 10 includes a slotted passageway 13 adjacent the juncture between arm portion 10 and cross arm portion 11. Preferably, slotted passageway 13 is rectangular with a long axis coinciding with the lengthwise central axis 45 of elongated arm portion 10.

Near the free end 42 of arm portion 10 is a plurality of spaced circular passageways 14 arranged in two pairs or sets 16 and 17 spaced symmetrically on each side of axis 45. Passageways 14 are of a size to permit passage therethrough of the spaced legs 43 of a peg board fixture 26 which are attachable through the holes 44 of the peg board 25. Passageways 14 are arranged in two pairs or sets 16 and 17 to accommodate different lengths of peg board fixtures, e.g., 4-inch and 6-inch. These lengths apply to the distance from the peg board to the free end of the hanger rod.

Adjacent each pair 16 and 17 is a fold line 18 and 19, respectively, placed between passageways 14 and 15 and cross arm portion 11. Each fold line 18 and 19 is lateral to the central axis 45 of arm portion 10 and is designed to permit arm portion 10 to assume a right angle bend so as to permit that portion of pair 16 or 17 to lie flat against a vertical peg board 25 and to permit the remainder of arm portion 10 to lie horizontally along the hanger rod 30 of the peg board fixture 26, as hereinafter more fully described in connection with FIGS. 3 and 4. Fold lines 18 and 19 are formed by heat and pressure to cause fusion of the plastic sheets 21 and 22 to occur and to compress the fused line into a thin section which folds easily and retains the folded conformation. Passageways 14 are preferably formed by pressing a suitable heated tool to form an annular seal 24 around the hole 14, leaving the central portion in place to be punched out when ready for use.

Figure 4:
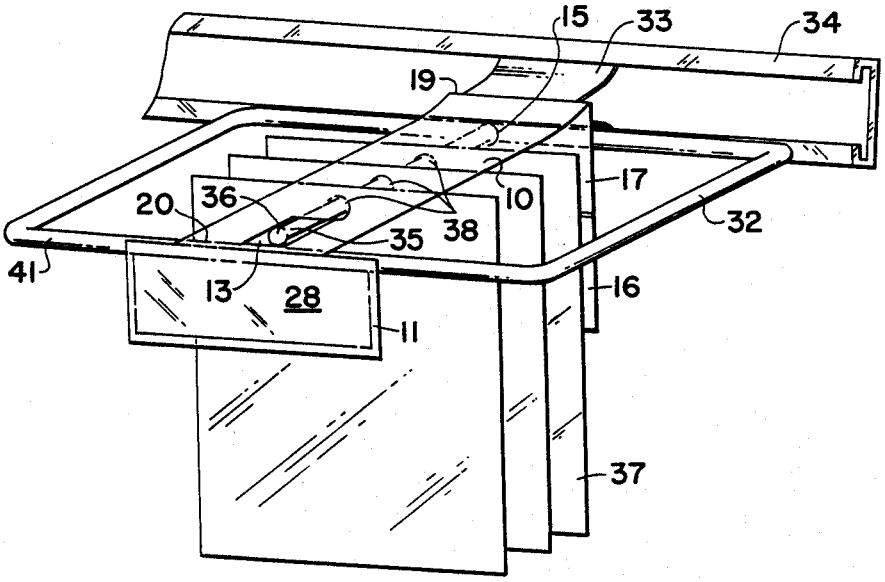
FIG. 4 is a perspective view of the tag holder of this invention used on a type of guarded J-hook hanger.

A single circular passageway 15 is shown located along central axis 45 and adjacent pair 17 of passageways 14. Passageway 15 is of a size and shape to permit passage of the central hanger rod of a J-hook hanger which is attachable to a channel as shown in FIG. 4. Passageway 15 is made in exactly the same manner as that described above with respect to passageways 14. For other sizes of hangers wherein a single attachment rod is employed there may be other passageways like 15 along axis 45 at whatever location is suitable for that size hanger fixture. Fold line 19 cooperates with passageway 15, and any other similar passageways could readily be prepared and located appropriately to cooperate with either of fold lines 18 or 19.

Figure 3:
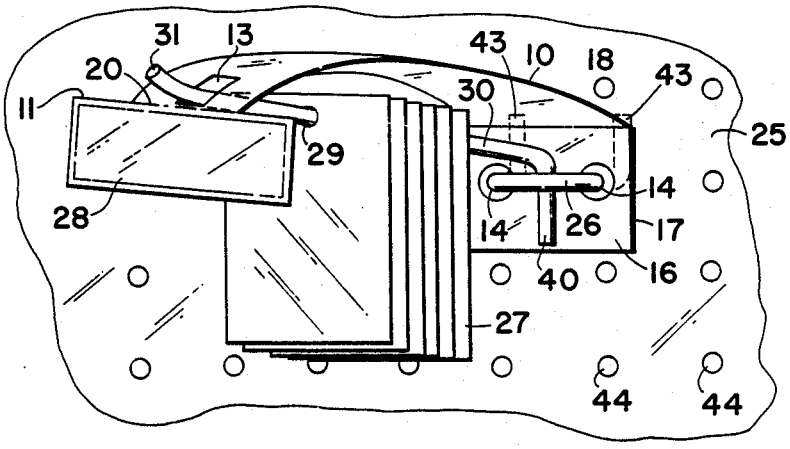
FIG. 3 is a perspective view of the tag holder of this invention used on one type of peg board hanger.

In FIG. 3 there is shown the use of the display tag holder of this invention with a peg board 25 and a peg board fixture 26 having two spaced legs 43 which extend through spaced holes 44 in peg board 25 and a hanger rod 30 projects generally horizontally outward from peg board 25. Goods mounted on cards or encased in plastic pouches have holes 29 which slide over free end 31 of hanger rod 30 for display. The display tag holder is attached by the legs 43 of fixture 26 passing through spaced passageways 14 in set 16 or 17 and then through the holes 44 in peg board 25. Fixture 26 usually has a supporting tail piece 40 which presses against peg board 25 to support goods 27 hanging on rod 30. The pressure of tail piece 40 onto set 16 or 17 helps to hold arm portion 10 firmly in place with its central axis overlying in substantial alignment with rod 30. Fold line 18 is folded to permit the remainder of leg portion 10 to extend forward over the top of hanger rod 30 with slot 13 falling over free end 31 of rod 30 to permit free end 31 to pass therethrough. Fold line 20 is folded to permit cross arm portion 11 to hang vertically downward with pocket 12 on the rearward side of cross arm portion 11 so as to hold identification tag 28 therein. As one of items 27 is removed by sliding it forward off free upturned end 31, arm portion 10 and slot 13 will automatically raise to permit removal of item 27 and after removal will automatically fall back into place with free end 31 projecting out of slot 13 thereby inhibiting inadvertent removal of the other items.

In FIG. 4 the tag holder according to this invention is used with a guarded J-hook for supporting goods 37. In this instance J-hook fixture 32 has a rectangular guard piece 41 and a central hanger rod 35 joined to a slide 33 which fits within a channel or track 34 that normally is fastened to a shelf, merchandise fixtures or wall. Hanger rod 35 has an enlarged knob 36 at its free end to inhibit the goods 37, hung on rod 35 by means of a hole 38 from unintentionally sliding off the rod 35. Hole 38 and knob 36 are respectively sized such that items 37 are attached to or removed from rod 35 with a little difficulty. Passageway 15 is sized to fit rod 35 and is used to attach the display tag holder thereto. Fold line 19 is folded so that arm portion 10 will lie generally horizontally over rod 35 along central axis 45. Slot 13 assists in positioning leg portion 10 over rod 35. Fold line 20 is folded to permit cross arm portion 11 to hang vertically over the front portion of guard piece 41 and to permit an identification tag 28 to be carried in pocket 12 accessible from the rear side of cross arm portion 11.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A display tag holder comprising a flat T-shaped strip of two coextensive sheets of transparent plastic material heat welded together along the edges thereof, one of said sheets being stiffer than the other, said strip including an elongated arm portion and a relatively short lateral cross arm portion attached medially thereof to one end of said elongated portion, said cross arm portion including a pocket means therein adapted to receive an identification tag said elongated arm portion having a slotted passageway therethrough adjacent said cross arm portion and having adjacent the opposite end thereof a pair of laterally spaced circular passageways therethrough of substantially the same size and spacing as adjacent horizontal openings of a peg board to which said tag holder is attachable, said elongated arm portion having a lateral fold line adjacent said pair of circular passageways and positioned between said pair of circular passageways and said cross arm portion.

2. The tag holder of claim 1 wherein a molded fold line is located on the lateral line common to said elongated arm portion and said cross arm portion.

3. The tag holder of claim 1 wherein said pocket means comprises a piece of the less stiff plastic sheet heat welded on three sides to the perimeter of said cross arm portion.

4. The tag holder of claim 1 wherein said slotted passageway is a rectangular slot positioned along the longitudinal axis of said elongated arm portion, said slot being adapted to receive therethrough a free end of a peg board hanger or the like.

5. The tag holder of claim 1 further comprising a second pair of laterally circular passageways spaced longitudinally from said pair of circular passageways said elongated arm portion having a second lateral fold line adjacent said second pair of circular passageways and positioned between said second pair of circular passageways and said cross arm portion, said fold lines being substantially parallel to each other.

6. The tag holder of claim 5 which includes two molded fold lines, one being midway between said two sets of circular passageways and the other being similarly spaced from said circular passageways closer to said cross portion.

7. A display tag holder adapted to be used with a peg board and peg board hanger from which goods for display are hung, said tag comprising a flat T-shaped strip of three sheets of chemically identical transparent plastic heat sealed to each other around the entire perimeter thereof, the central sheet of said three sheets being relatively thick and stiff and the outside two sheets of said three sheets being relatively thin and flexible, said T-shaped strip including an elongated rectangular arm portion attached at one end thereof to a lateral rectangular cross arm portion along a molded fold line said cross arm portion including on one side thereof a fourth sheet of said plastic heat sealed around three sides to the three sides of said cross arm portion and adapted to receive and hold therein an identification card, said elongated arm portion having a rectangular passageway therethrough adjacent said attachment to said cross arm portion, and adjacent the free end of said elongated arm portion, a pair of laterally spaced circular passageways therethrough adapted to permit passage of the legs of said peg board hanger therethrough, and a molded lateral fold line adjacent to said pair of circular passageways and located between said pair of circular passageways and said cross arm portion.

8. The tag holder of claim 7 wherein said rectangular passageway has a long axis and a short axis, with the long axis coinciding with the lengthwise axis of said leg portion.

9. The tag holder of claim 7 wherein said spaced circular passageways include two passageways aligned lateral to the length of said elongated arm portion and of such size and space interval to receive the leg portion of a suitable peg board hanger.

10. The tag holder of claim 9 which includes two sets of said two passageways, said sets being spaced apart lengthwise of said elongated arm portion and adjacent the free end thereof, each set having a lateral molded fold line adjacent the respective set of circular passageways and located between said set of circular passageways and said cross arm portion.

11. A display tag holder adapted to be used with a guarded J-hook member slidably attached to a support track and from which goods for display are hung, said tag comprising a flat T-shaped strip of three sheets of chemically identical transparent plastic heat sealed to each other around the entire perimeter thereof, the central sheet of said three sheets being relatively thick and stiff and the outside two sheets of said three sheets being relatively thin and flexible, said T-shaped strip including an elongated rectangular arm portion attached at one end thereof to a lateral rectangular cross arm portion along a molded fold line, said cross arm portion including on one side thereof a fourth sheet of said plastic heat sealed around three sides to the three sides of said cross arm portion and adapted to receive and hold therein an identification card, said elongated arm portion having a rectangular passageway therethrough adjacent said attachment to said cross arm portion, and adjacent the free end of said elongated arm portion, a circular passageway therethrough adapted to permit passage of said J-hook member therethrough and a molded lateral fold line adjacent said circular passageway and located between said circular passageway and said cross arm portion.

12. The tag holder of claim 11 wherein said rectangular passageway has a long axis and a short axis, with the long axis coinciding with the lengthwise axis of said elongated arm portion.

13. A display tag holder adapted to be used with a peg board hanger or a guarded J-hook hanger from which goods for display are hung, said tag comprising a flat T-shaped strip of three sheets of flexible polyvinylchloride transparent film heat sealed to each other around the entire perimeter thereof, the central sheet of said three sheets being about 12 mils thick and the outside two sheets of said three sheets being about 6 mils thick, said T-shaped strip including an elongated rectangular arm portion attached at one end thereof to a short lateral rectangular cross arm portion along a molded fold line said cross arm portion including on one side thereof a fourth sheet of said plastic heat sealed around three sides to the three sides of said cross arm portion and adapted to receive and hold therein an identification card, said elongated arm portion having an elongated rectangular passageway therethrough adjacent said attachment to said cross arm portion said elongated passageway having a lengthwise axis which coincides with the lengthwise axis of said elongated arm portion; two pairs of laterally spaced circular passageways symmetrical about said lengthwise axis, one of said pairs being adjacent the free end of said elongated arm portion and the other of said pairs being spaced from said one pair lengthwise of said elongated arm portion to a position between said one pair and said cross arm portion, a first lateral molded fold line perpendicular to said lengthwise axis and located between said one pair and said other pair, a second lateral molded fold line parallel to said first fold line and located between said other pair and said cross arm portion, and a fifth circular passageway located on said lengthwise axis adjacent said other pair of circular passageways.

* * * * *